United States Patent [19]
Nelson et al.
[11] 4,363,698
[45] Dec. 14, 1982

[54] METHOD FOR DRYING AND BURNING VISCOUS AQUEOUS LIQUORS WHICH CONTAIN ORGANICS

[75] Inventors: Hugh W. Nelson, West Hartford; George J. Prohazka, Simsbury, both of Conn.; Keith W. Morris, Ashton, Canada

[73] Assignee: Combustion Engineering, Inc., Windsor, Conn.

[21] Appl. No.: 316,587

[22] Filed: Oct. 30, 1981

Related U.S. Application Data

[62] Division of Ser. No. 163,836, Jun. 27, 1980.

[51] Int. Cl.[3] ..... D21C 11/12
[52] U.S. Cl. ..... 162/30.1; 162/30.11; 423/207; 423/DIG. 3
[58] Field of Search ..... 162/30 K, 30 R, 30.1, 162/30.11; 422/184, 185; 110/224, 238; 122/7 C; 423/207, DIG. 3

[56] References Cited

U.S. PATENT DOCUMENTS 2,928,184 3/1960 Lonngreen ..... 42/185
3,053,615 9/1962 Steinert ..... 423/207

FOREIGN PATENT DOCUMENTS 1066857 11/1979 Canada ..... 162/30.1

*Primary Examiner*—Peter F. Kratz
*Attorney, Agent, or Firm*—Arthur L. Wade

[57] ABSTRACT

Sawdust is mixed with partially concentrated black liquor from pulp manufacture. The sawdust, coated with the solids of the black liquor, is dried by heated air. The sawdust, coated with organic and inorganic black liquor solids, is fed to the hearth of a chemical recovery boiler. Combustion of the char formed on the boiler hearth produces heat which causes additional organic material to pyrolize. The inorganic material combines to form molten smelt. The moisture-laden, heated air from the dryer is introduced into the boiler with the secondary air and the smelt is tapped off into an aqueous solution to form green liquor.

5 Claims, 1 Drawing Figure

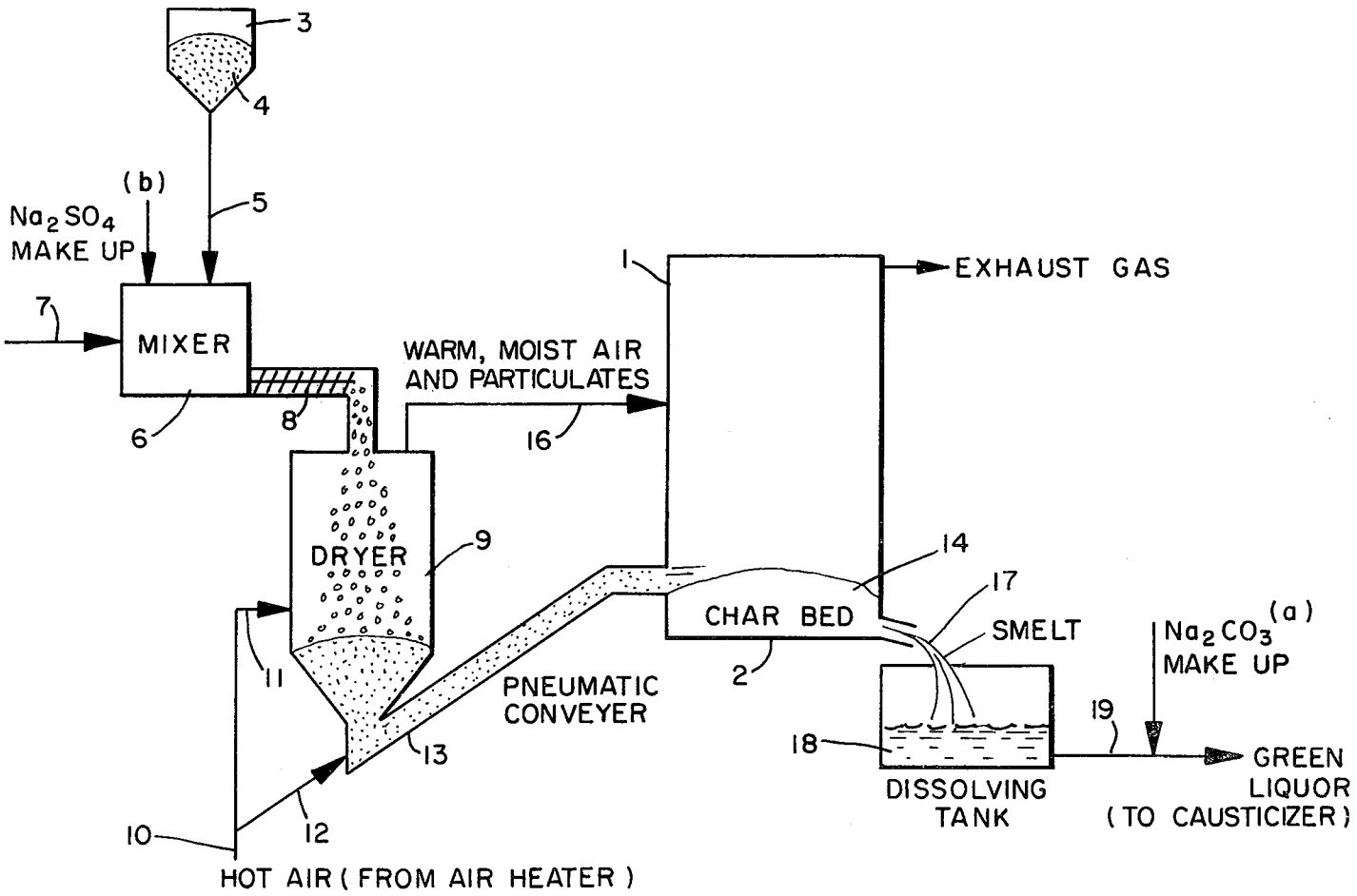
EXHAUST GAS
1
CHAR BED
2
14
17
SMELT
DISSOLVING TANK
18
19
$Na_2CO_3$ (a) MAKE UP
GREEN LIQUOR (TO CAUSTICIZER)
WARM, MOIST AIR AND PARTICULATES
16
PNEUMATIC CONVEYER
13
9
DRYER
8
11
12
HOT AIR (FROM AIR HEATER)
10
3
4
5
MIXER
6
(b) $Na_2SO_4$ MAKE UP
7

METHOD FOR DRYING AND BURNING VISCOUS AQUEOUS LIQUORS WHICH CONTAIN ORGANICS

This is a division of application Ser. No. 163,836, filed June 27, 1980.

TECHNICAL FIELD

The present invention relates to the separation of the water and solids of black liquor with the subsequent generation of smelt. More particularly, the invention relates to providing an extended, porous surface on which is coated the solids of black liquor from which hot air may evaporate the water of the black liquor in order to introduce the dry material providing the extended surface, with its coat of solids, into a chemical recovery boiler for reduction to smelt.

BACKGROUND ART

The overall process in which lignin is extracted from wood chips to produce cellulose in pulp manufacture is well developed. An aqueous solution of two kinds of active alkali, such as sodium hydroxide and sodium sulfide, forms a white liquor in which wood chips, or other cellulosic materials, are digested for several hours under heat and pressure in the kraft pulping process.

In the digesting process, the lignin is dissolved by the white liquor and is removed from the cellulose fibers of the wood. At this point the organic lignin fraction becomes a part of the 15% solid content of the aqueous solution which is now termed weak black liquor.

Losses of sodium and sulfur compounds normally occur in the pulp and flue gas streams leaving a pulp mill. Therefore, amounts of sodium sulfate are added to the heavy black liquor as makeup. A substantial degree of concentration of the weak black liquor is carried out in direct and/or indirect evaporators, producing a heavy black liquor with a solid content of 63% to 68% when normal North American hard and soft woods are pulped. The pulping of tropical hardwoods, or non-wood materials like bamboo, bagasse, or straw, by contract, produces highly viscous liquors which cannot be concentrated above about 40–50% solids. These require the burning of large amounts of expensive auxiliary fuels (gas or oil) to sustain combustion in a boiler. This practice is unsatisfactory, also, because of low reduction efficiency, high emission of sulfur dioxide, and a greatly increased chance of blackouts and smelt-low solids liquor (steam) explosions.

It is conventional practice to introduce a coarse spray of heavy black liquor at an elevation mechanically well above the hearth in a chemical recovery boiler. This spray falls through the hot gases rising from the burning char bed on the hearth. During the descent of the drops through the hot gases, the remaining 32–37% water is evaporated and the dry solid particles fall to the hearth at the bottom of the boiler where they are pyrolized. Pyrolysis produces char which is burned, leaving the inorganics as molten smelt. This smelt is dissolved in water to form an aqueous solution called green liquor. Causticizing the green liquor by adding slaked lime completes its reconstitution into white liquor by changing inactive sodium carbonate into active sodium hydroxide so that it may be brought into contact with wood chips in the digestion to continue with the pulp-making process.

It is desirable that as much of the water of the black liquor, as commercially feasible, be driven from the solids before pyrolysis, burning, and the formation of the smelt is attempted in the present boiler. Under the present practice, this automatic sequential treatment of the black liquor requires a boiler volume large enough to accommodate the complete sequence of black liquor treatment. Evaporation of the approximate 32–37% residual water of the black liquor in the furnace cavity cools and slows the burning process.

The operation of the boiler is somewhat complex. Mechanically, the black liquor is spray-formed into about $\frac{1}{4}''$ to $\frac{1}{2}''$-size drops at about 15 feet above the hearth. The drops cannot be smaller than about $\frac{1}{4}''$, or some of the molten smelt, formed by burning the small liquor particles in flight, will be swept up by the combustion air to foul boiler heat transfer surfaces.

If the black liquor solids can be formed in a coat on a porous extended surface, and the water can be evaporated from the black liquor solids faster and more completely before introduction into the boiler, the resulting charge of dry black liquor solids will enable a significant decrease in the size of the boiler and increase in the bed-burning temperature and reduction efficiency. In addition, if the extended surface is provided by porous combustible material, the combustible material will become an additional source of heat for the boiler. In short, there is a need to shift the final water evaporating step upstream of the boiler to obtain significant improvements in economy and speed in forming smelt, with essential active alkali, and steam from the black liquor solids. No present commercially feasible process is available to permit this important shift.

DISCLOSURE OF THE INVENTION

The present invention contemplates mixing porous, finely-divided solid, combustible material with black liquor to coat the extended surface of the combustible material with the solids of the black liquor and subsequently passing heated air over the mixture to evaporate the water of the black liquor. The combustible material, with its porous extended surface coated with the black liquor solids, is then fed to the hearth of a chemical recovery boiler to form a char bed which burns to produce heat, clean steam, and a smelt of highly reduced, low-combined oxygen content, inorganic material which can then form the aqueous solution of green liquor.

The invention further contemplates passing the heated air, used to dry the solid material, into the boiler as secondary air.

Other objects, advantages, and features of the invention will become apparent to one skilled in the art upon consideration of the written specification, appended claims and accompanying drawing.

BRIEF DESCRIPTION OF THE DRAWING

The drawing is a schematic of a portion of a black liquor recovery system in which the present invention is embodied.

BEST MODE FOR CARRYING OUT THE INVENTION

General Plan

The present invention can be used in the separation of water from many viscous aqueous organic solutions in which the solids must be processed by furnace heat. For instance, sewage sludge might be dried in this manner to dispose of it and concomitantly generate clean by-product steam. Of the possible modes in which the invention can be disclosed, that part of pulp manufacture in which chemicals and heat are recovered from so-called black liquor is the best mode for carrying out this invention.

The embodiment centers around a boiler in which combustion heat is transferred to water. The water is heated to convert it to clean steam which is used at many locations in the overall paper manufacture. The boiler has all of the problems conventionally associated with heat exchanging a combustion process with the water. Additionally, the furnace of this embodiment has the problem of sustaining combustion on its hearth with a most peculiar mixture of low heating value substances which have high fouling and air pollution potentials.

The black liquor of kraft pulp manufacture is a complex combination of organic and inorganic substances. By contrast, white liquor is a simple solution of sodium hydroxide and sodium sulfide. Digesting chips of wood in the white liquor dissolves the lignin which holds the cellulose fibers of the wood together. There follows the mechanical problems of removing the cellulose and drawing off the spent aqueous solution as weak black liquor. Disclosure of the present invention is not directly served by consideration of subsequent chemical additions to the liquor and partial conventional evaporation of its water content. The vital factor is that the present invention solves the problem of separating a large portion of the water of the heavy black liquor, no matter how high its viscosity, from its organic and inorganic solids, feeding the dry solids to the hearth of the furnace, combusting the organic portion of the solids and reducing the inorganic sodium-sulfur-oxygen substances efficiently to active alkali, sodium sulfide.

The molten inorganic ash is termed "smelt" which, in its molten state, flows continuously from the boiler into water to form greem liquor. The transformation of the green liquor to white liquor, by causticizing, to close this cycle of the pulp manufacture has its own problems unrelated to the present invention.

It is the overall plan of the present disclosure to provide porous finely-divided solid material for mixture with the heavy black liquor. Some form of sawdust, or finely ground pith for non-wood pulping, has been found to be satisfactory material to mix with the black liquor in suitable proportion, and provide a large surface upon which the solids of the black liquor will be dispersed to form a non-sticky, pulverulent mixture.

Further, the coated sawdust particles can be exposed to a drying medium, such as heated air, to remove the water to a satisfactory degree. The remaining dry product can then be conveyed mechanically, or by an air stream, to the furnace hearth. At the same time, the warm moisture-laden air from the dryer can be introduced at a suitable location into the boiler, as in the secondary air stream, to conserve its heat content and to prevent any adverse cooling effects of the moisture on the burning char bed below.

Compared with the prior art, it is reasonable to expect that the present invention will make possible a smaller boiler and hearth. Further, the efficiency with which the organic material is combusted on the hearth and the inorganic sulfur compounds are reduced to form active alkali (sodium sulfide) in the smelt will be increased. In addition, the increased bed burning temperature resulting from dry fuel will decrease the emission of air-polluting sulfur gases, such as hydrogen sulfide and/or sulfur dioxide, from the furnace. Little more can be asked of the invention which shrinks the size of the equipment which embodies the invention, enables the drying and burning processes in the equipment and boiler to be carried out more speedily and efficiently, decreases the emission of sulfur gas pollutants in the flue gas, and can be employed to burn viscous types of liquors which cannot currently be handled economically in a boiler.

Specific Embodying Structure

Boiler 1 is the center of the structure in that its hearth 2 receives the combustible material in the forms supplied by the invention. The combustion that takes place on hearth 2 produces heat which is transferred to water flowing through tubes forming the walls and the hearth of boiler 1. Details of the boiler are not disclosed as they are conventional and well-known. The supply of the combustible material to hearth 2 begins with the bin vessel 3.

Bin vessel 3 represents a storage structure for cheap, finely-divided, combustible, porous material which provides an extended surface available to support a coat of organic and inorganic solids of black liquor. Wood sawdust 4, or ground pith for bamboo or bagasse pulping, will meet these specifications and conduit 5 gravitates the sawdust into mixer 6.

No purpose of the disclosure will be served by elaborating on the internal structure of mixer 6. It is sufficient to indicate hot, heavy, black liquor is conducted into mixer 6 through conduit 7. Of course, the liquor arrives from upstream evaporators not shown. The exact characteristics of the resulting mixture of sawdust and black liquor hardly needs discussion. Mechanical feeder 8 simply transports the mixture from mixer 6 into drying vessel 9.

Within vessel 9 the mixture from 6 is brought into intimate contact with dry heated air. The heated air is conducted from heating equipment, not shown, through conduit 10. Conduit 10 is disclosed as truncated into conduits 11 and 12. Branch conduit 11 is introduced into the side of dryer 9 as representative of the hot air being passed over and through the mixture as the mixture descends into the dryer from mechanical feeder 8. Additional agitation and contact between the air and coated sawdust may result from the introduction of hot air from branch conduit 12. However, the air from branch conduit 12 is introduced into the lower portion of dryer 9 at a point where it gas-lifts the dried material up conduit 13. Conduit 13, of course, is connected to boiler 1 at the point where the dried mixture from conduit 13 is delivered to hearth 2.

Initiation of combustion on the hearth 2 is, of course, important, but not of concern to disclosing the present invention. The bed 14 of char on hearth 2 is burned while its inorganic content is smelted. Secondary air for the combustion may be at least partially supplied by the warm moist air in conduit 16 connected between dryer 9 and boiler 1.

The smelt formed by burning char on hearth 2 is drawn continuously, in a molten state, through conduit 17 and flowed downwardly into water in dissolving tank 18. The aqueous solution of green liquor formed in tank 18 is then conducted to the causticizer through conduit 19, and then, as white liquor, back to the digester to complete the cycle.

CONCLUSION

Despite the focus on the Best Mode for Carrying Out the Invention being disclosed as a method and apparatus for handling the black liquor of paper manufacture, the inventors do not see their invention limited to this mode. Where an aqueous solution contains both combustible organic material and inorganic elements which are valuable enough to be recovered, the present invention will be of significant advantage.

Aqueous solutions containing solid material may be concentrated to a point of high viscosity and offer a severe problem in their further reduction. The last step of separation may be combustion of the organic portion of the solids and be frustrated by the inability to economically remove the aqueous phase so that combustion may proceed. This is the problem with black liquor and may well be the problem with the handling of other aqueous solutions, such as sewage. Therefore, the use of an extended surface which can be coated with the solids and over which warmed dry gases may be passed, will be a practical solution. The aqueous phase will be picked up by the warm dry gas and leave the organic and inorganic solids as a coat on the extended surface. Broadly speaking, if the extended surface is provided by a combustible material and the organic solids are combustible as well, both materials may be burned away from the inorganic solids. The heat of combustion can be used to generate clean steam for various uses and the inorganic solids may be flowed from the hearth and recovered.

From the foregoing, it will be seen that this invention is one well adapted to attain all of the ends and objects hereinabove set forth, together with other advantages which are obvious and inherent to the method and apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

We claim:

1. A method for recovering smelt from black liquor, including, mixing hot heavy black liquor with material comprising sawdust or pith which is solid and porous and finely divided and combustible to coat the material with the solids of the liquor, then passing heated air over the mixture to remove the water of the liquor, then heating the material coated with the solids of the liquor in a boiler to pyrolyze and burn the organic portion of the solids and smelt the inorganic portion of the solids, heating water with the combustion to convert the water into clean steam, and passing the molten smelt into water to form green liquor.

2. The method of claim 1 in which, the moist heated air passed from the mixture is flowed into the boiler as secondary air of the combustion.

3. A process for recovery of the inorganic solids of black liquor, including, coating a finely divided and porous and combustible solid comprising sawdust or pitch with the organic and inorganic solids of black liquor, then vaporizing the aqueous phase of the black liquor by passing heated air over the coated particles of the finely divided solid, then pyrolizing and burning the organic solids of the black liquor and the finely divided solid coated with the black liquor solids in a chemical recovery boiler while the inorganic solids of the black liquor form a smelt, supplying the air and vaporized aqueous phase of the black liquor to the boiler as secondary air of combustion, and withdrawing the molten smelt of inorganic solids from the boiler to form green liquor.

4. The process of claim 3, including, heating water in the boiler with the heat of pyrolizing and combustion of the finely divided solid and organic solids of the black liquor to form steam, and passing the steam to a point of use.

5. The process of claim 3, in which, the finely divided and porous and combustible solid coated by the black liquor solids is sawdust.

* * * * *